US008409365B2

(12) United States Patent
Cox

(10) Patent No.: US 8,409,365 B2
(45) Date of Patent: Apr. 2, 2013

(54) GUTTER CLEANING DEVICE

(76) Inventor: Gregory Keith Cox, Snow Hill, NC (US)

( * ) Notice: Subject to any disclaimer, the term of this patent is extended or adjusted under 35 U.S.C. 154(b) by 512 days.

(21) Appl. No.: 12/610,249

(22) Filed: Oct. 30, 2009

(65) Prior Publication Data

US 2011/0100403 A1 May 5, 2011

(51) Int. Cl.
*B08B 3/00* (2006.01)

(52) U.S. Cl. ..... 134/166 C; 134/166 R; 134/167 R; 134/168 R; 134/168 C; 134/167 C; 134/169 R; 134/169 C; 134/171

(58) Field of Classification Search ..... 134/166 R, 134/167 R, 168 R, 168 C, 167 C, 169 R, 134/169 C, 171, 166 C
See application file for complete search history.

(56) References Cited

U.S. PATENT DOCUMENTS

| | | | | |
|---|---|---|---|---|
| 2,910,711 | A | 3/1958 | Mizelle | |
| 4,150,793 | A | 4/1979 | Russo | |
| 4,182,497 | A | 1/1980 | Ferreira et al. | |
| 4,183,368 | A * | 1/1980 | Husted | 134/166 R |
| 4,303,348 | A | 12/1981 | O'Brien | |
| 4,304,498 | A | 12/1981 | George | |
| 4,349,039 | A | 9/1982 | Egger | |
| 4,363,335 | A | 12/1982 | Tapper | |
| 4,673,129 | A | 6/1987 | Kologiy | |
| 4,756,043 | A | 7/1988 | Hazelet | |
| 4,978,241 | A | 12/1990 | Lawson | |
| 5,022,586 | A | 6/1991 | Putnam | |
| 5,386,942 | A * | 2/1995 | Dietle | 239/532 |
| 5,390,853 | A | 2/1995 | Ellul | |
| 5,573,024 | A | 11/1996 | DeVaney et al. | |
| D392,781 | S | 3/1998 | McKnight | |
| 5,727,580 | A * | 3/1998 | Patterson | 134/115 R |
| 2006/0289036 | A1 * | 12/2006 | Hilton | 134/22.11 |
| 2007/0044387 | A1 * | 3/2007 | Herrera | 52/12 |
| 2009/0127349 | A1 * | 5/2009 | DeLeo | 239/1 |

* cited by examiner

*Primary Examiner* — Michael Barr
*Assistant Examiner* — Charles W Kling
(74) *Attorney, Agent, or Firm* — The Parker Law Office, PLLC

(57) ABSTRACT

A gutter cleaning device comprising a nozzle body preferably detachably coupled to a wand in fluid communication with a pressurized water source, the nozzle body having a fluid passage means providing fluid communication to a first nozzle obtusely offset from a coplanar, simultaneously operating, second nozzle wherein the first nozzle and the second nozzle are offset about 158 degrees.

2 Claims, 6 Drawing Sheets

GUTTER CLEANING DEVICE

BACKGROUND OF THE INVENTION

1. Field of Invention

This invention relates generally to gutter cleaning devices and the like, and especially devices adapted to clean high or difficult to reach gutters where the backpressure generated by water emitted from the device makes management of a cleaning wand difficult.

2. Description of the Prior Art

Gutters provide an effective means of diverting water from a rooftop to downspouts. However, debris builds up in gutters over time. For effective use, the gutters must be cleaned. While gutters can be cleaned by hand, this approach usually requires ladders and can be dangerous and time consuming. If a ladder is not available one often climbs onto the roof to clean the gutter, increasing the likelihood of a fall. Various devices have been developed to make gutter cleaning easier.

Wand type cleaning devices generally allow a person to stand on the ground and clean a gutter. Wand type devices generally consist of an elongated conduit having one end attached to a water hose or other water source. The other end typically has a water outlet and may have other fixed cleaning implements. This outlet end is generally reversely bent so that water emitted from the outlet is directed down into the gutter. The attached cleaning implements are used to agitate and dislodge clumped debris and assist breaking it into smaller pieces. The flow of water from the device directs the broken debris either out of the gutter or towards the downspout. Typical wand devices have one water outlet or nozzle adapted to spray a water jet into the gutter to dislodge and break-up debris while the flow of water in the gutter carries the debris away. Some devices include two nozzles or outlets that may be used alternately, but not simultaneously.

While wand-type devices provide a more efficient means of cleaning gutters, they do exhibit some problems. Water emitted from the wand can have significant force. For lower rooflines and gutters, this may not be a problem since a person operates the devices at a great enough angle from vertical that the person is able to hold the device in place. However, if the water pressure is great, or if the angle from vertical is small, the backpressure may be too great to hold the wand in place during use. This is especially true when cleaning gutters on taller buildings where pressure washers or pumps are used to increase water pressure feeding into the device.

To ensure the device remains in position, various implements have been developed and adapted into the wand-type devices. These aids include cleaning tools adapted to hook over the outer-edge of the gutter, guides designed to roll along the gutter edge, or devices designed to roll inside the gutter. However, these devices have their own limitations in feasibility, usefulness with a variety of gutter systems, and ease of use depending on gutter height and water pressure. Not all gutters may be constructed the same and may not be able to take advantage of the guides in these devices. Also, high-pressure systems still tend to be difficult to manage since the water jet emitted from the device forces the device away from the gutter. This negative effect is magnified when a person attempts to use a device from a personnel lift or personnel basket.

SUMMARY OF THE INVENTION

The present invention is directed to wand-type hand-held devices for cleaning gutters while on the ground or on a telescoping personnel lift or basket. In one embodiment the device comprises a nozzle body detachably coupled to an elongated conduit serving as a handle having a lower end operatively coupled to a water source supplying water under pressure. The nozzle body preferably detachably couples to the opposite end of the conduit. The nozzle body includes an inlet receiving water flow from the conduit outlet. Preferably, a first nozzle and a second nozzle attach to the nozzle body, both in fluid communication with the inlet. The nozzles are preferably coplanar; however, the nozzles are arranged such that their directions of flow are obtusely offset. The backpressure from a one of the offset nozzles counteracts that of the other nozzle so that a person can more easily direct the water jet into the gutter without losing control of the device.

The invention and the various features of novelty that characterize the invention are pointed out in the specification and claims annexed to and forming a part of this disclosure. For a more complete understanding of the invention, its operating advantages and uses, reference should be made to the accompanying drawings and descriptive matter in which there is illustrated preferred embodiments of the invention.

DETAILED DESCRIPTION OF THE INVENTION

Figure 1:
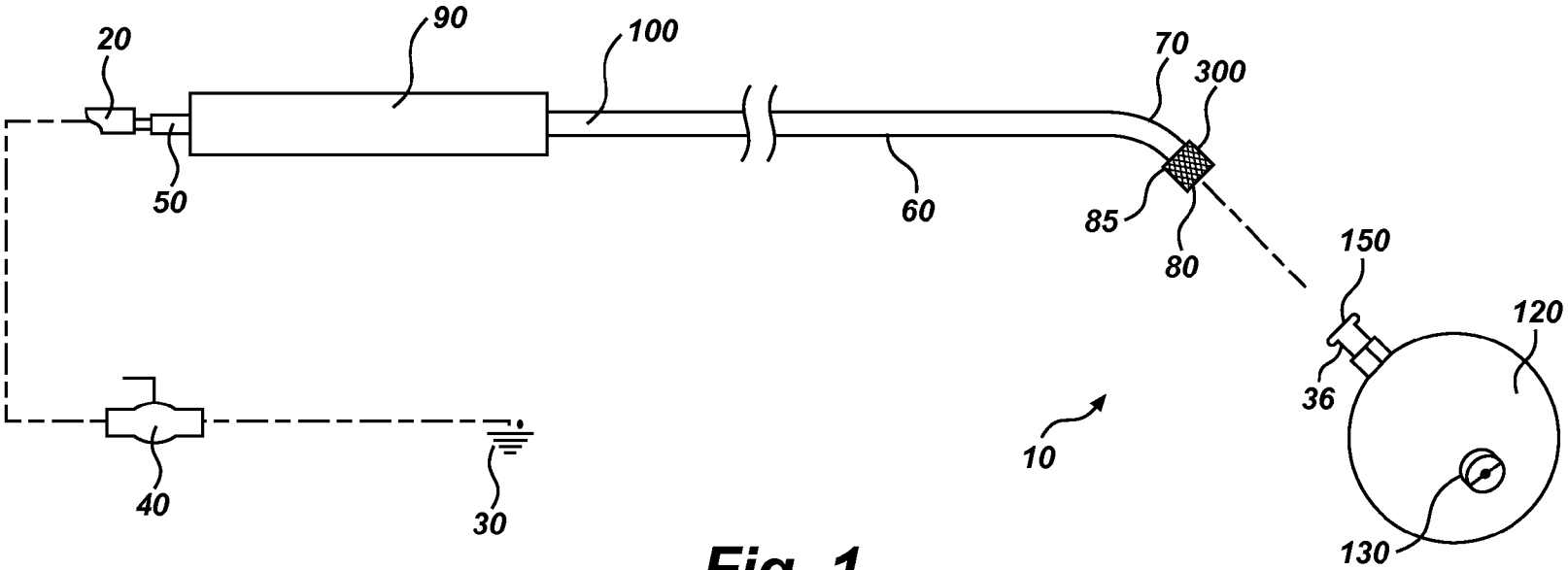
FIG. 1 shows an elevation view assembly drawing of a cleaning device nozzle body adapted to detachably couple to a pressure-washing wand in one embodiment of the invention.

Referring now to the drawings in greater detail, FIG. 1 depicts a gutter-cleaning device 10 comprising a hand-held wand 60 having a nozzle body 120 attached to a water supply hose 20. The hose 20 connects to a pressurized water source 30 such as a power washer. Alternatively, the device 10 could be connected to a standard garden hose 20 further connected to a water source 30 or other suitable pressurized water sources 30. A power washer is preferred since it provides sufficient water pressure to properly operate the device 10 and break up gutter 230 debris. A valve 40 operably disposed either in the wand 60 or between the source 30 and the wand 60 controls the water flow to the device 10. The valve 40 may be any of a variety of valves 40 typically used in power washer and garden wands 60 such as a gate valve 40 or trigger gun. The valve 40 may alternately be detachably coupled to the hose 20 through a variety of coupling means, including quick-release couplings to make attachment and detachment from the hose 20 easier. Other embodiments may lack a valve 40. These embodiments would instead couple directly to the hose 20 through a coupling means. Water flow in these embodiments could be controlled remotely at the source 30.

Figure 2:
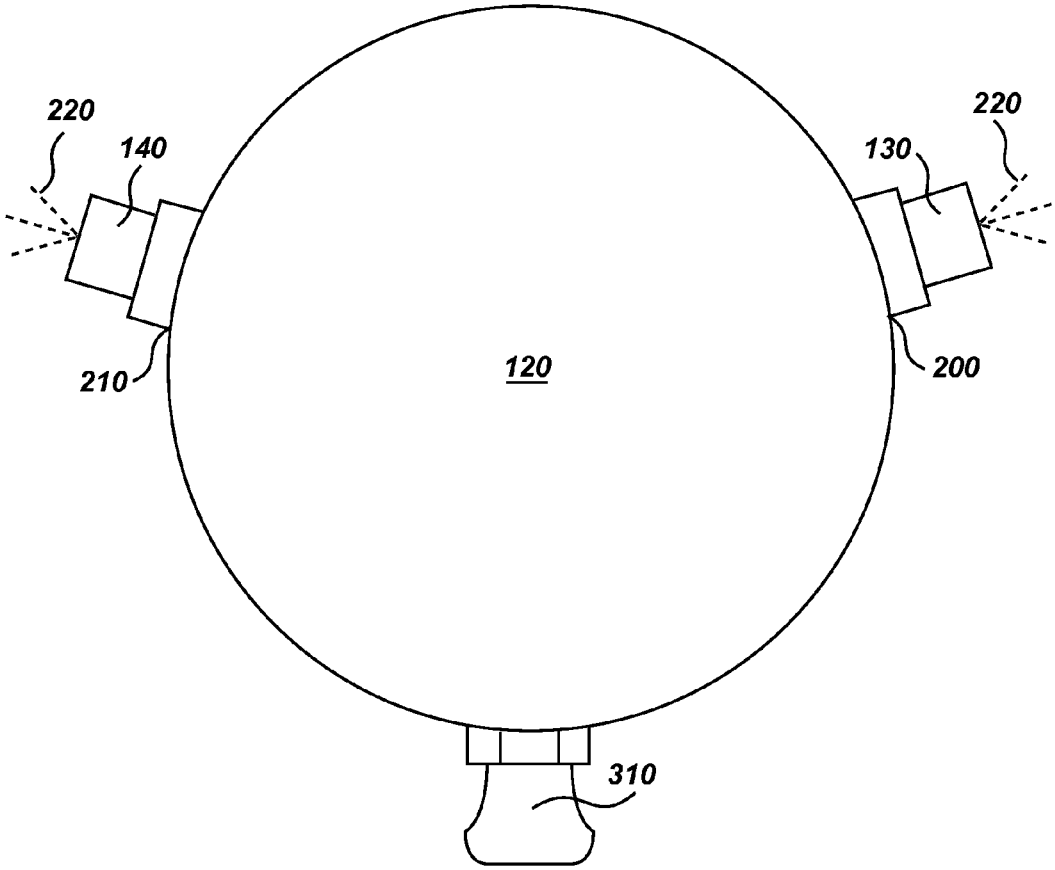
FIG. 2 shows a plan view of a cleaning device nozzle body.

As depicted, the valve 40 is affixed to a source end 50 of the wand 60. In this application, the terms handle, conduit 60 and wand 60 may be used interchangeably except where otherwise clearly noted or indicated by usage. The conduit 60 has a generally arcuate top portion 70 on an opposite end portion 85 distal from the source end 50 adapted to redirect the flow of water 220 through the conduit 60 back toward the gutter 230. This reverse-bend arrangement facilitates use of the wand 60 by a person standing on the ground and generally below the gutter 230. The arcuate top portion 70 may be formed with a range of bends relative to the wand 60 longitudinal axis ranging from obtuse, providing significant redirection back downward, to acute, providing redirection to approximately horizontal, or even no bend at all. As further shown on FIG. 2, FIG. 5 and FIG. 6, Water 220 exits the conduit 60 through an outlet 80. In the illustrated embodiment, the outlet 80 and the opposite end portion 85 longitudinal axes are coincident, with the conduit 60 opposite end portion 85 defining the outlet 80. Other configurations may also be used wherein a cap seals the opposite end portion 85 and the opposite end portion 85 and outlet 80 longitudinal axes are not coincident. Where the outlet 80 and opposite end portion 85 longitudinal axes are not coincident, the outlet 80 may be formed by a drilled or machined channel into and through the conduit 60 wall 100. Yet other embodiments may include capped ends having the outlet 80 formed by a drilled or machined channel through the cap. Any of a variety of ergonomic grips 90 facilitating use is preferably provided on the wand 60. These grips 90 may be any of a variety of grip 90 styles and designs including without limitation plastic grips 90 attached to the conduit 60, formed foam grips 90 adapted to frictionally engage the conduit's 60 outer wall 100, soft rubber frictionally engaging grips 90, and the like. The conduit 60 is preferably metal tubing designed for the device 10 operating pressure. Tubing provides weight advantages offering ease in handling and fatigue reduction with high strength. Tubing diameter is selected to ensure proper flow volume and pressure. Generally, commercially available pressure washer wands 60 may be utilized with the nozzle body 120 described herein for situations where the operator is able to maneuver within close proximity of a gutter 230. For taller gutters 230, specialized elongate wands 60 may be utilized constructed from tubing as previously described.

The nozzle body 120 having a first nozzle 130 and a second nozzle 140 couples to the opposite end portion 85 of the device 10. The nozzle body 120 preferably detachably couples. The first nozzle 130 and second nozzle 140 may be any conventional nozzle means adapted to emit fluid under pressure such as those 20 utilized with power washers. An inlet means 150 receives water 220 flow from the outlet 80 into the nozzle body 120. The nozzle body 120 may couple with the opposite end portion 85 by a variety of methods. The nozzle body 120 may have an internally threaded inlet means 150 adapted to engage an externally threaded opposite end portion 85. Alternately, the internally threaded inlet means 150 may receive an end of a threaded nipple with a threaded coupling connecting the opposite nipple end with the threaded opposite end portion 85. In a preferred embodiment, a female quick-connect coupling 300 is disposed on the opposite end portion 85 for receiving a mating male quick-connect coupling 310 affixed in the internally threaded end inlet means permitting easy detachment and reattachment of the nozzle body 120.

Figure 3:
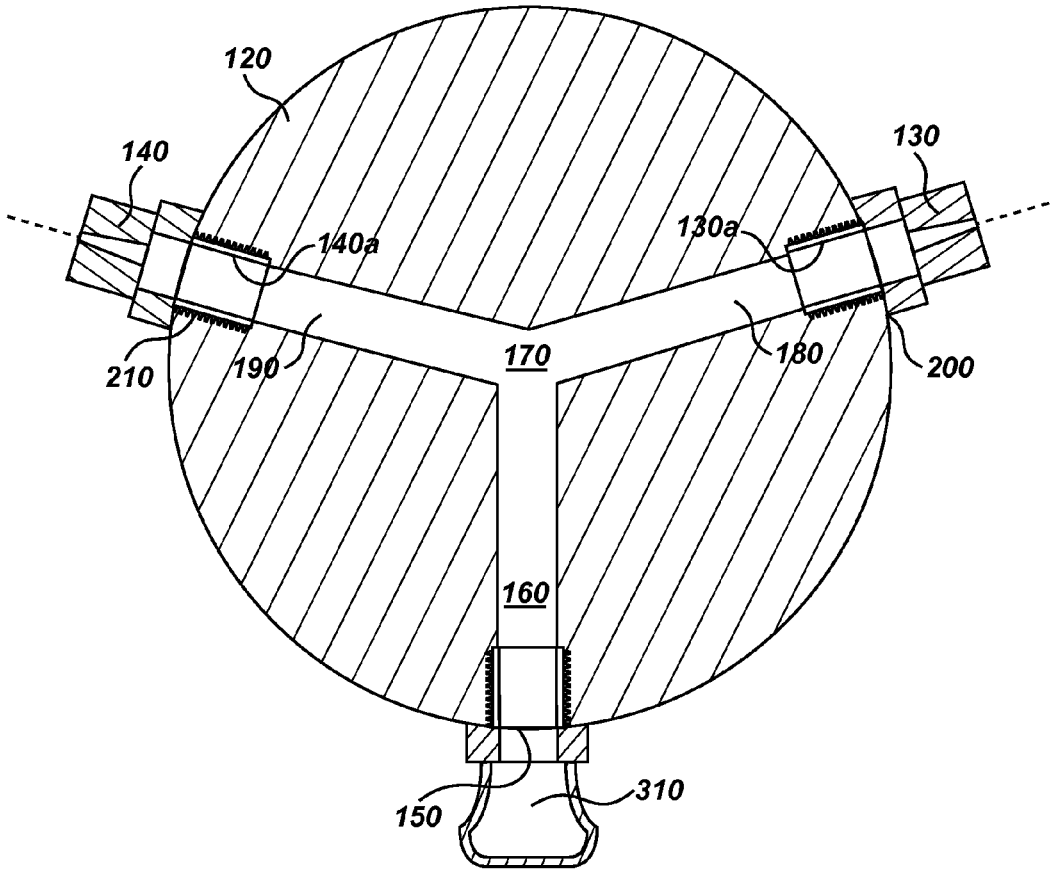
FIG. 3 shows a cutaway plan view of a cleaning device nozzle body along the line A-A of FIG. 2.
Figure 4:
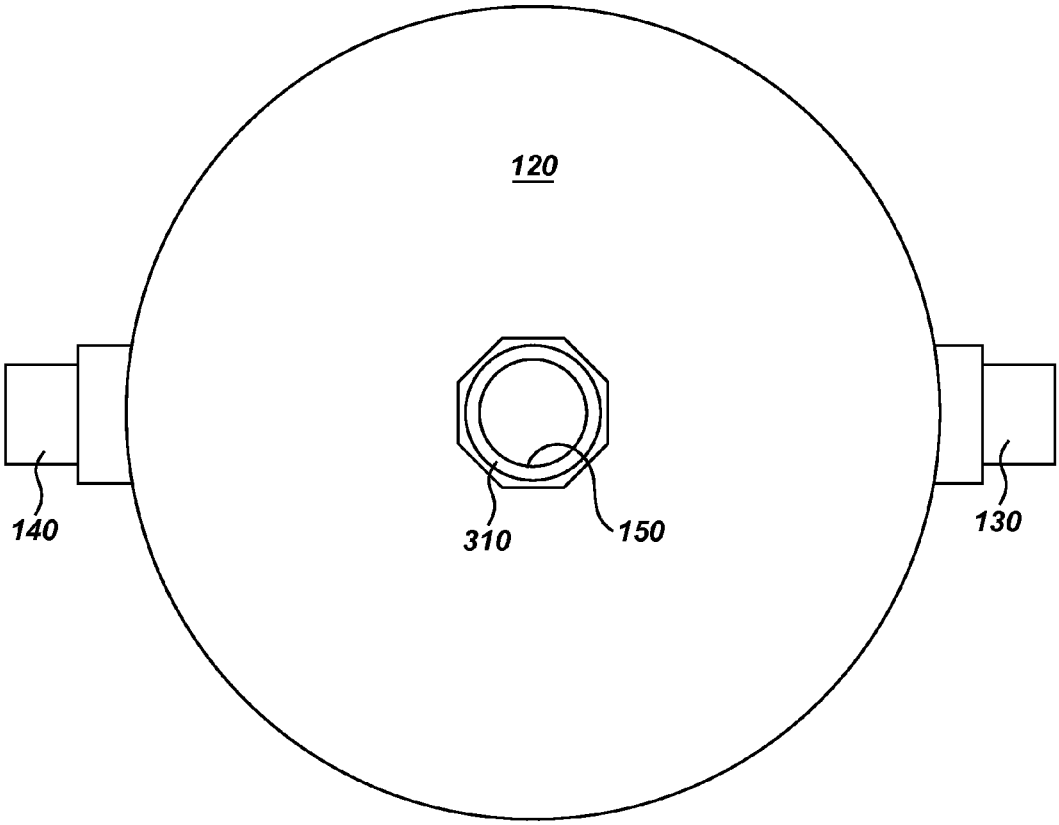
FIG. 4 shows an elevation rear view of a cleaning device nozzle body.

Water 220 flows from the conduit 60 through the outlet 80 and into the inlet means. Referring now to FIG. 3 and FIG. 4, a fluid passage means 160 provides fluid communication between the inlet means 150 and the first nozzle 130 and the second nozzle 140. As depicted, water 220 flows from the inlet 150 through the fluid passage 160 to a branch 170 in the fluid passage means 160. The branch 170 in the fluid passage 160 is similar to tee or wye formed or machined using conventional means into the nozzle body 120 splitting the water 220 flow into two branches 170. The first branch 180 carries water 220 to the first nozzle 130 and the second branch 190 carries water 220 towards the second nozzle 140. The first nozzle 130 and second nozzle 140 are affixed to the nozzle body 120 in a coplanar configuration whereby the first nozzle 130 flow direction is obtusely offset from the second nozzle 140 flow direction. Typically, an internally threaded first port 200 and second port 210 receive an externally threaded end (130*a*, 140*a*) of the first nozzle 130 and second nozzle 140, respectively. While a range of offset positions may be used, spacing between the range of 120 degrees and 158 degrees provides satisfactory performance, with a preferred embodiment having an offset of 158 degrees. Other embodiments may include offsets ranging from 120 degrees to 180 degrees. Both the first nozzle 130 and the second nozzle 140 simultaneously emit water 220 under pressure during operation. Backpressure from Pressurized water 220 existing a nozzle in a typical cleaning device 10 tends to force the cleaning device 10 in the opposite direction. However, the simultaneous operation of the obtusely offset first nozzle 130 and second nozzle 140 generates sufficient opposing forces to provide enhanced control of the device 10 without forcing the device 10 to "kick-out" or move out of operational range in relation to the gutter 230 (FIG. 5) that typically results from backpressure force. Configurations with offsets of 90 degrees or less generate backpressure forces that reduce operability, tending to force the device 10 away from the gutter 230 and reducing or eliminating the positive effects generated by the simultaneous offset nozzle teachings disclosed herein. Depending on the device 10 arrangement and the bend present in the top portion 70, the first nozzle 130 and second nozzle 140 may be further offset relative to the nozzle body 120 longitudinal axis to ensure proper downward orientation of emitted water 220 to the gutter 230. It should be understood that this offset refers to the common plane within which the first nozzle 130 and the second nozzle 140 lie. Additionally, the first nozzle 130 and second nozzle 140 are preferably chosen to emit a fan pattern. In a preferred embodiment, the emitted water 220 fan pattern plane is generally between a range of 30 degrees to 60 degrees relative to the gutter 230 trough 240. This range facilitates coverage of the entire gutter 230 trough 240 and sides proximate the building.

A spherical shape preferably characterizes the nozzle body 120. This shape provides enhanced versatility by reducing abutting surfaces and corners that might snag or catch in a gutter 230 during use. The spherical shape also provides enhanced visual appeal making the device 10 easily identifiable. As previously described, the nozzle body 120 shape may be machined from a solid piece of material stock with the inlet means and fluid passage means 160 machined into the nozzle body 120 by conventional means. Other embodiments may be constructed wherein the fluid passage is defined by short pieces of tubing or pipe coupled to a tee or wye and appurtenant elbows as needed to provide the desired offsets described for the first nozzle 130 and second nozzle 140. In such embodiments the nozzle body 120 may include a multi-part spherical shell adapted to envelope the hard-piped fluid passage. A variety of materials could be used to make the shell including hard plastics, formed sheet metal, fiberglass, or any other material that may be spherically formed or shaped using conventional means. The multipart shell pieces may be affixed together or to the fluid passage components via conventional means known in the arts for adjoining the selected material. It should be understood that flexible tubing and appurtenant couplings could also be used to define the fluid passage means 160. Multipart spherical shell envelopes the tubing defining the fluid passage means 160 in a similar manner as the "hard-piped" fluid passage means 160. In yet other embodiments the nozzle body 120 may be hollow such that the hollow interior of the nozzle body 120 defines the fluid passage. While the spherical shape is preferred for its aesthetic benefits and maneuverability, other nozzle body 120 shapes may also be used effectively with the offset nozzle configuration disclosed herein. Depending on the shell construction and connection methods used, the first nozzle 130 and the second nozzle 140 may be affixed to the nozzle body 120 shell, or they may connect directly to the components defining the fluid passage means 160. Such connections would be made using conventional methods such as through connected pipefittings according to the nozzle body 120 configuration used. Other embodiments may lack the shaped characteristics of the disclosed nozzle body 120 while still providing reduced backpressure benefits, such as where the fluid passage is "hard-piped" using a tee, appurtenant tubing, and required couplings.

To provide enhanced flexibility, the nozzle body 120 may be a separately available component offering different configurations of nozzles, offsets, or component configuration. By way of example, nozzles emitting water 220 at a lower pressure may be available with a smaller offset between the nozzles, while another nozzle body 120 may be offered having high pressure nozzles with a greater offset between the nozzles, while yet other nozzle body 120 styles may offer configurations of nozzle pressure or offsets anywhere within the desired ranges of operation depending on the intended use. Where the nozzle body 120 is detachably coupled to the conduit 60 as preferred, multiple nozzle body 120 devices 10 may be offered having different angles between the nozzles so that an operator can choose the nozzle body 120 best adapted to the work conditions. Alternately, a nozzle body 120 may include quick-connect fittings for detachably coupling matching sets of an interchangeable, detachably coupled first nozzle 130 and second nozzle 140. In this embodiment, a set of a first nozzle 130 and a second nozzle 140 may be quickly interchanged to allow for the most efficient configuration without changing the nozzle body 120. In yet other embodiments where the operator desires to rotate the nozzle body 120 relative to the gutter 230 as described more thoroughly herein below, the first nozzle 130 and the second nozzle 140 may operate at different output pressures. Using this configuration, the lower operating pressure first nozzle 130 could be utilized in close proximity to the gutter 230 while the higher operating pressure second nozzle 140 provides greater counter-force to offset the backpressure of the first nozzle 130. Such embodiments provide a wide array of choices to enhance the operability and functionality of the device 10.

Figure 5:
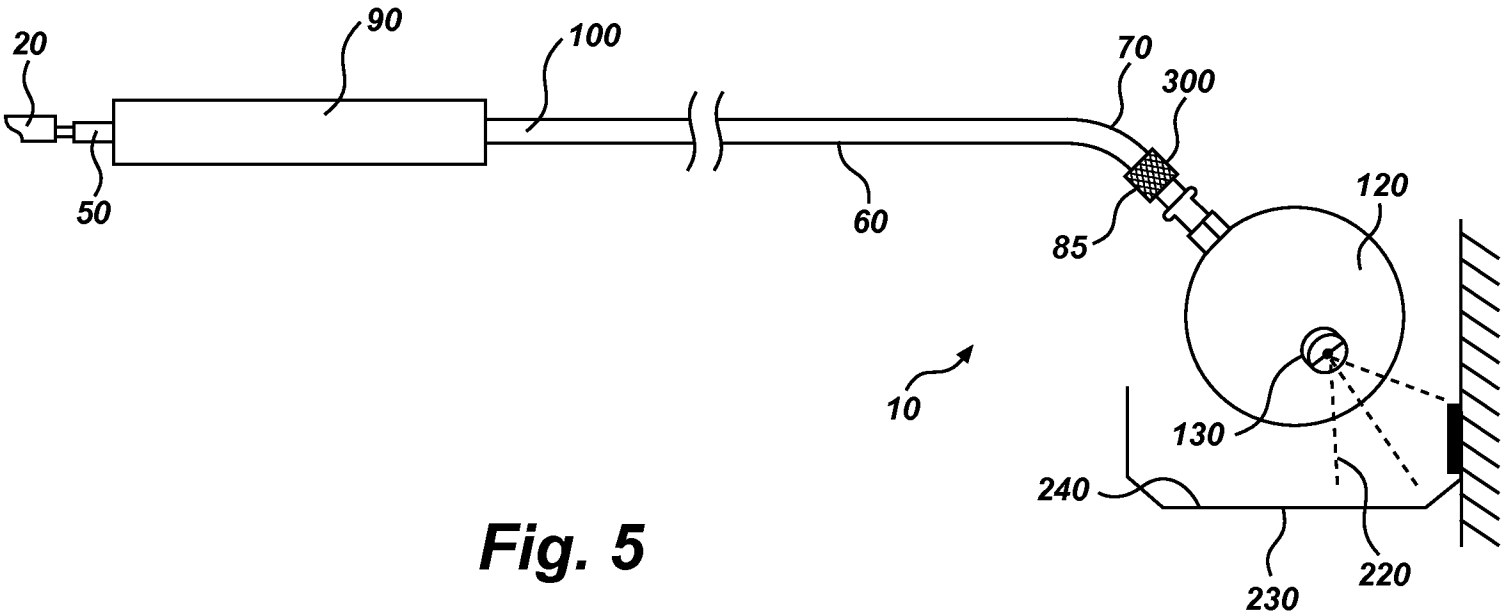
FIG. 5 shows an elevation view of a cleaning device nozzle body coupled to a wand emitting water into a gutter during operation.
Figure 6:
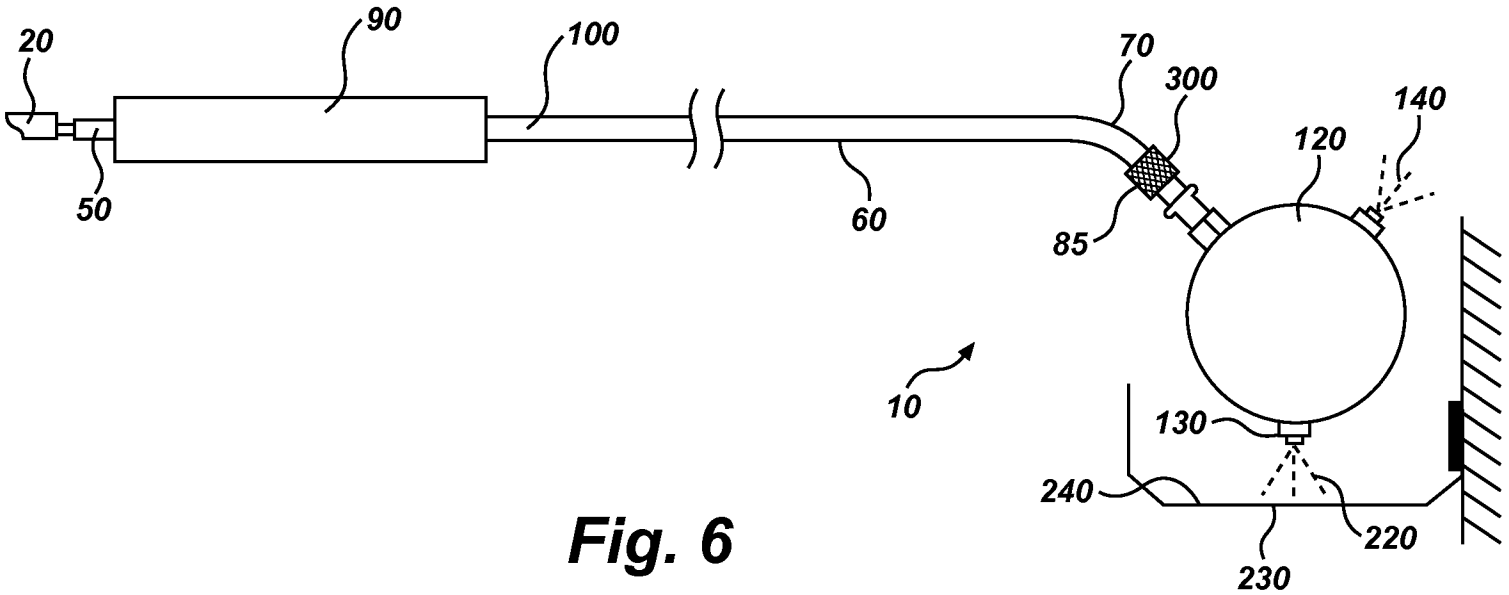
FIG. 6 shows another elevation view of a cleaning device nozzle body coupled to a wand emitting water into a gutter wherein the nozzle body is rotated approximately 90 degrees during operation.

Referring now to FIG. 1, FIG. 3, and FIG. 5, in operation, water 220 under pressure flows from the source 30 through the hose 20 to the source end 50, through the conduit 60 and out of the outlet 80 into the nozzle body 120 inlet means 150. The water 220 then flows from the inlet means 150 through the fluid passage means 160, through the first branch 180 and second branch 190, and finally to the first nozzle 130 and second nozzle 140 where the water 220 is simultaneously emitted in generally opposite directions. An operator holds the conduit 60 or wand 60 and directs the nozzle body 120 to close proximity with the gutter 230 trough 240. The nozzle body 120 may be maneuvered parallel to the trough 240 while water 220 emitted from the nozzle body 120 breaks up debris. Emitted water 220 further directs accumulated water 220 that carries loose debris and dirt through the trough 240 to downspouts. If additional pressure is required to break up or dislodge debris, the operator may rotate the conduit 60 about its vertical axis to either side to change the emitted water 220 angle of inclination with the debris as generally shown in FIG. 6. As depicted, the nozzle 130 is approximately perpendicular to the gutter 230 trough 240. This position would be optimal for cleaning downspouts positioned throughout a typical gutter 230. In a preferred method of operation, the device 10 would be rotated gently from side to side such that one nozzle 130 generally directs water towards the trough 240 while the second nozzle 140 directs water upward or away from the trough 240. While this movement tends to increase the backpressure on the device 10, the emitted water 220 from the opposite nozzle 140 continues to provide sufficient backpressure forces to allow the operator to maintain the nozzle body 120 in close proximity to the trough 240 without losing control of the device 10 or experiencing "kick-out" associated with traditional devices 10. The increased range of movement within close proximity of the trough 240 without the negative effect associated with emitted water 220 backpressure is a significant enhancement over conventional devices 10. The disclosed design is flexible in that a wide range of movements can be accomplished while varying the angle of water 220 emission from the nozzle body 120 relative to the gutter 230 to more effectively and efficiently dislodge debris. Further, the device 10 lacks traditional guides or appendages typically used to retain a nozzle in close proximity with the gutter 230. The backpressure reduction allows greater operator flexibility with reduced operator effort. Reduced effort allows operators to more effectively work the device 10 to dislodge debris and clean the gutter 230.

The practicalities of the device 10 are especially apparent in cleaning gutters 230 on high rooflines. In such settings, traditional devices 10 controlled by an operator standing on the ground is difficult since the increased conduit 60 length needed to reach the gutter 230 acts as a fulcrum, multiplying the negative effects of emitted water 220 backpressure. Additionally, high gutters 230 make operation with guides or appendages more difficult since their operation from a great distance is usually difficult for an operator on the ground. The simultaneous water 220 emission achieved through applicant's device 10 allows not only cleaning along both sides of the nozzle body 120 within the gutter 230, but allows operator flexibility in attacking lodged debris while providing positive assistance, by way of the second nozzle 140 emitted water 220 pressure, to an operator in keeping the nozzle body 120 in close proximity of the gutter 230 and debris to be dislodged.

As has been demonstrated, the present invention provides a novel gutter 230 cleaning device 10 in the form of a nozzle body 120 which may be preferably detachably coupled to a wand 60 that overcomes the negative effects of the prior art. The present invention is particularly well suited for gutters 230 on tall buildings since the negative backpressure effects of emitted water 220 are magnified. The present invention further provides for offset, concurrently operating nozzles that both clean and reduce the negative backpressure effects associated with their cleaning characteristics.

Further, the prior art does not teach obtusely offset nozzles on a pressure washing wand 60 or nozzle body 120. Nor does the prior art teach the use of a detachably coupled nozzle body 120 having such offset nozzles. The prior art does not provide for the use of traditional power washing nozzles disposed in an offset pattern in close proximity with the gutter 230 surface where the operator is at a significant distance from the gutter 230 since such nozzles tend to generate sufficient backpressure that effectiveness is reduced.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. A gutter cleaning device comprising:

a nozzle body provided with an inlet;

a detachable coupling means in fluid communication with the inlet for detachably coupling the nozzle body to a gutter cleaning wand;

a fluid passage in fluid communication with the inlet;

a first nozzle affixed to the nozzle body coplanar with an obtusely offset second nozzle affixed to the nozzle body, the first nozzle offset about 158 degrees from the second nozzle;

the first nozzle and second nozzle in fluid communication with the fluid passage.

2. A gutter cleaning device comprising:

a spherical nozzle body provided with an inlet;

a detachable coupling means in fluid communication with the inlet for detachably coupling the nozzle body to a gutter cleaning wand;

a fluid passage in fluid communication with the inlet;

a first nozzle affixed to the nozzle body coplanar with an obtusely offset second nozzle affixed to the nozzle body, the nozzle offset between the first nozzle and the second nozzle is an angle within the range of 140 degrees to 172 degrees.

* * * * *